US005861860A

United States Patent [19]

Stanek et al.

[11] Patent Number: 5,861,860

[45] Date of Patent: Jan. 19, 1999

[54] PROTECTOR FOR ONE OR MORE ELECTROMAGNETIC SENSORS

[75] Inventors: Tomas Stanek, Mölndal; Stefan Johansson, Romelanda, both of Sweden

[73] Assignee: Telefonaktiebolaget LM Ericsson, Stockholm, Sweden

[21] Appl. No.: 698,708

[22] Filed: Aug. 16, 1996

[30] Foreign Application Priority Data

Aug. 17, 1995 [SE] Sweden ..... 9502859

[51] Int. Cl.[6] ..... H01Q 15/02

[52] U.S. Cl. ..... 343/909; 343/708; 343/872

[58] Field of Search ..... 343/909, 872, 343/840, 781 P, 781 R, 708; H01Q 15/02, 15/100

[56] References Cited

U.S. PATENT DOCUMENTS

| | | | |
|---|---|---|---|
| 4,851,858 | 7/1989 | Frisch | 343/909 |
| 5,103,241 | 4/1992 | Wu | 343/909 |
| 5,162,809 | 11/1992 | Wu | 343/909 |
| 5,208,603 | 5/1993 | Yee . | |
| 5,563,614 | 10/1996 | Alden et al. | 343/909 |

FOREIGN PATENT DOCUMENTS

| | | |
|---|---|---|
| 0434374 | 6/1991 | European Pat. Off. . |
| 2253519 | 9/1992 | United Kingdom . |

*Primary Examiner*—Don Wong
*Assistant Examiner*—Tho Phan
*Attorney, Agent, or Firm*—Burns, Doane, Swecker & Mathis, L.L.P.

[57] ABSTRACT

A frequency-selective surface designed to transmit (allow to pass through) electromagnetic radiation around one or more predetermined transmission frequencies. The frequency-selective surface comprises at least two layers, whereby the outer layer is made up of at least one electromagnetic reflecting layer with a periodic pattern of conductive elements. The periodic pattern of conductive elements is made to have a reflection resonance frequency for electromagnetic radiation which is of the order of three times higher than the desired transmission frequency. The inner layer is placed at a suitable predetermined distance from the outer layer. The inner layer is made up of at least one electromagnetic transmitting layer having a periodic pattern of aperture elements. The periodic pattern of aperture elements is made in order to have a transmission resonance frequency for electromagnetic radiation which is substantially the same as the desired transmission frequency.

10 Claims, 5 Drawing Sheets

PROTECTOR FOR ONE OR MORE ELECTROMAGNETIC SENSORS

BACKGROUND

The present invention relates to an arrangement for protecting (shielding) one or more electromagnetic sensors against undesirable electromagnetic radiation.

In many connections there is a desire to protect (shield) one or more electromagnetic sensors, for example antennas, from undesirable electromagnetic radiation and mechanical influences. Very often it is desirable to protect the sensor's sensitive electronics from interfering and/or destructive signals and to influence/reduce/alter the radar signature of the sensor. An object's radar signature is the object's three-dimensional electromagnetic radiation diagram which is obtained from it being irradiated with electromagnetic signals of differing frequencies and from the object's self-produced electromagnetic radiation. An object's radar signature can also be seen as a diagram of the object's equivalent reflection surface in three dimensions, which of course only gives a picture of the radar signature for incident radiation.

One way of achieving a protector/shield which fulfils the aforementioned desire is by using a frequency selective surface/radome (FSS—Frequency Selective Surface, RADOME —RAdar DOME).

In the construction of frequency-selective surfaces, periodic patterns consisting of aperture elements can be used, for example slits which, simply expressed, are holes of some form in an electrically-conductive plane, or periodic patterns can be used which consist of electrically-conductive elements, for example dipoles or printed conductive elements, which can be described as electrically-conductive islands in some form on an insulated plane. These two types of periodic pattern give rise to surfaces with different frequency behaviour.

If aperture elements are used, the surface transmits at the aperture elements' resonant frequency $f_0$. This means that the surface will have a transmission window (compare with pass-band filters) where the maximum transmission through the surface is obtained at a frequency which is determined by the elements' resonant frequency with a wavelength $\lambda$ (element length~$\lambda/2$ {$\lambda$=electrical wavelength}). If on the other hand, conductive elements are used, the surface will reflect at the elements' resonant frequency. That means that the surface will have a reflection window (compare with suppression/stop-band filters) where the maximum reflection is obtained at a frequency which is determined by the elements' resonant frequency (element length~$\lambda/2$).

The natural choice when constructing a frequency-selective surface/radome is a periodic pattern with aperture elements. Such a surface has a transmission window, i.e. it is transparent for a chosen frequency range. By combining two or more such layers with a space between the layers, the characteristics of the radome can be additionally improved/altered, i.e. full transmission at a desired transmission frequency can be obtained, as well as steeper flanks in the window.

This type of construction has several disadvantages however, partly due to the fact that a radome with such a surface is electromagnetically open (has a pass-band) at multiples of the resonant frequency ($nf_0$, n=1, 2, . . . ), but also due to the fact that the periodic pattern gives rise to grating lobes for frequencies from about $1.5f_0$ (for a typically conventional radome construction). Grating lobes are undesirable lobes, radiation, which occur due to interference when electromagnetic radiation at a suitable frequency meets or transmits through a surface with a periodic and symmetric pattern.

The frequency of the radiation at which the grating lobes occur depends on the packing density of the periodic pattern. If the elements lie more sparsely than $\lambda/2$, grating lobes occur in the radome's radar signature. That means that the grating lobes will occur for electromagnetic radiation with a wavelength $\lambda$ which is less than two times the distance between the elements.

In other words, the electromagnetic protection (shielding) which the FSS-radome gives to the sensor is limited. The sensor is electromagnetically unprotected at frequencies which are multiples of the sensor's own frequency and additionally the sensor's radar signature is worsened in that the grating lobes, which were perhaps not present previously, may be introduced at the sensor's own frequency or near to it. The electromagnetic protection which the radome provides is for incident radiation with frequencies lower than the sensor's own frequency, for these frequencies the FSS-surface appears approximately as a purely metallic surface.

Problems with multiple transmission windows present themselves, inter alia, if the FSS-radome is constructed for reasons of radar signature, i.e. if one of the purposes of the radome is to protect sensors which lie behind it from being seen. Another occasion where multiple transmission windows are a problem is if the purpose is to protect the sensor's electronics which lie behind it from both interfering and destructive signals. The problem with grating lobes is only coupled to the desire to reduce/alter the radar signature, on the condition that these do not already occur at an undesired resonant frequency, in which case even the sensor's/antenna's own characteristics are disturbed.

The method of using a periodic aperture pattern in a frequency-selective surface/radome is described in published articles. The method of combining a plurality of layers of similar pattern in order to obtain different characteristics in the FSS-surfaces is also described.

U.S. Pat. No. 5,208,603 discloses a solution, in which an outer layer consisting of periodic patterns of apertures is combined with an inner interposed layer consisting of a periodic pattern of conductive elements. The purpose according to the patent is to obtain a compact radome solution which transmits at two frequencies. The purpose of the middle layer consisting of conductive elements is to achieve a coupling between the aperture layers, which thereby allows transmission at two frequencies. The described solution does not solve the problem of the radome being open to multiple frequencies of the undesired transmission frequencies. The construction allows a denser packing of the elements than with a conventional solution, which means that the grating lobes can be avoided at $f_0$. But since the layer which is the interface to the surroundings consists of apertures and is resonant for an undesired transmission frequency $f_0$, the packing density of the apertures will however be such that the grating lobes will occur from about $2f_0$.

In British patent GB 2 253 519 a solution is described having an FSS-surface consisting of densely packed layers with periodic patterns of elements which can be apertures and/or conductive elements. The purpose is to obtain a surface, the transmission/reflection characteristics of which can be altered by the layers being displaced relative to one another. The layers are constructed for transmitting or reflecting at a given frequency which can be changed by the layers changing position with respect to each other. There is nothing in the method which prevents transmission at multiple frequencies or the occurrence of grating lobes. The solution which is presented in the British patent is not intended to solve these problems and neither does it do this.

SUMMARY

One object of the invention is to define a frequency-selective arrangement/surface which allows transmission of, i.e. is transparent to, incident and emitted electromagnetic radiation at one or more predetermined frequencies.

Another object of the invention is to define a frequency-selective arrangement which solves the problems with the occurrence of grating lobes around the desired transmission frequency/frequencies.

A still further object of the invention is to define a frequency-selective arrangement which allows transmission of electromagnetic radiation at one or more frequencies and prevents transmission at multiples of the transmission frequency/frequencies.

An additional object of the invention is to define a frequency-selective arrangement for one or more sensors and/or sending and/or receiving antennas (an antenna arrangement or antenna arrangements), which allows control of, and/or a reduction of, their radar signature.

The aforementioned objects are achieved in accordance with the invention by a frequency-selective surface/arrangement designed to transmit (allow to pass through) electromagnetic radiation around one or more predetermined transmission frequencies. The frequency-selective arrangement/surface comprises a plurality of layers, having at least one outer electromagnetic reflecting layer and one inner electromagnetic transmitting layer.

The outer layer is positioned closer to the surroundings than the inner layer. The inner layer is positioned closer than the outer layer to the antenna arrangement(s) that the frequency-selective arrangement is placed in front of, in order to be a frequency-selective arrangement for the antenna arrangement(s).

The outer layer comprises at least one electromagnetic reflecting layer where each reflecting layer comprises periodic patterns of electrically conductive elements. Each periodic pattern of electrically conductive elements is arranged to possess a reflection resonance frequency for electromagnetic radiation which is higher than the transmission frequency, preferably of the order of three times larger.

The frequency-selective surface's/arrangement's inner layer is placed at a predetermined distance from the outer layer, said distance being chosen dependent upon which characteristics the radome should have. The distance can for example be about $\lambda/4$ or about $\lambda/4+n\lambda/2$, where n=1, 2, 3 . . . (note that $\lambda$ is the electrical wavelength in the material which lies between the layers). The inner layer comprises at least one electromagnetic transmitting layer where each transmitting layer comprises a periodic pattern of aperture elements. Each periodic pattern of aperture elements is arranged to possess a transmission resonance frequency for electromagnetic radiation which is substantially the same as the transmission frequency.

BRIEF DESCRIPTION OF THE DRAWINGS

The invention will now be described in an explanatory, and in no way limiting, manner, with reference to the accompanying drawings which only serve the purpose of explanation, and in which.

DETAILED DESCRIPTION

In order to clarify the arrangement according to the present invention, some examples of its use will be described below in connection with FIGS. 1 to 9, in which it should be noted that the proportions are not necessarily correct.

In principle all electromagnetic sensors and transmitters, antenna arrangements, such as radar antennas, which belong to airborne equipment are provided with a protective radome. Even in a large amount of land-based and marine-based equipment, the transmitting and receiving antennas are protected with the aid of radomes. In principle, all of the following discussion which relates to airborne equipment is equally valid for marine-based equipment and also land-based equipment. Fast-moving boats and cars also need, for example, an aerodynamic exterior.

Figure 1:
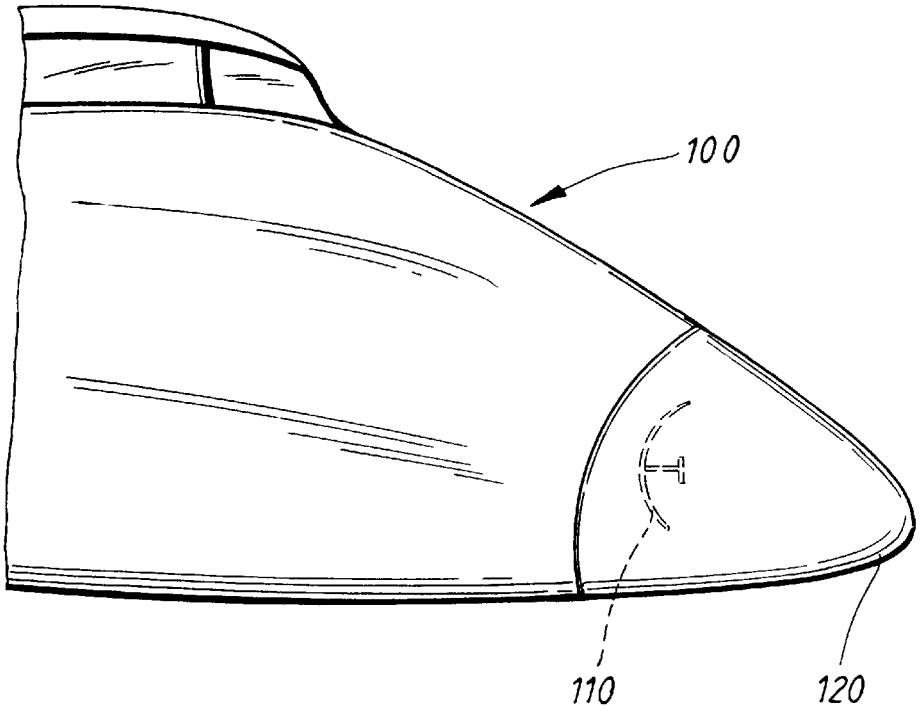
Fig. 1 (Prior Art)
FIG. 1 shows a schematic example of an aeroplane's nose having a radome which can be provided with the invention, FIG. 2 schematically shows an example of an earlier-known periodic pattern.
Figure 2:
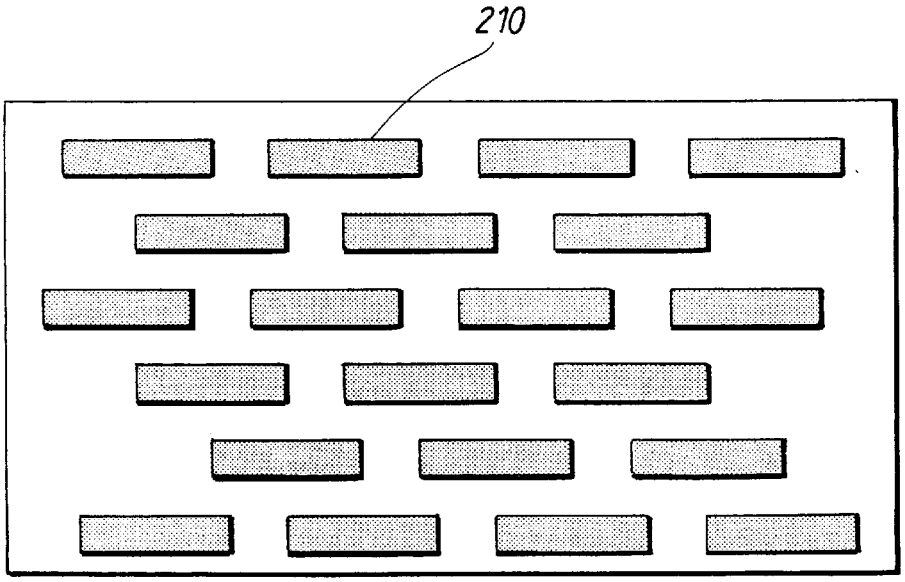
Fig. 2 (Prior Art)

FIG. 1 shows an electromagnetic sensor/antenna 110 which is mechanically protected behind a radome 120. The radome 120 is suitably electromagnetically transparent, mechanically stable so as to provide an aerodynamic protective casing in, for instance, the nose of an aeroplane 100 and aerodynamically adapted to the rest of the fuselage.

Since the receiver-technology has gone from valves to semi-conductor amplifiers, the sensitivity of the sensors has also increased both for the actual desired signal and for powerful destructive radiation. This has forced various protective circuits to be forwarded. These are most often optimised to operate best around, for instance, a radar's transmitting frequency due to the fact that the protective circuits are primarily there to protect the receiver circuits from powerful radiation during transmission from its own transmitter. In order to make it easier for the protective circuits, it may be suitable to make the radome frequency-selective, i.e. the radome only lets through, in both directions, the electromagnetic radiation which is within the desired frequency range.

One way of constructing a frequency-selective surface is to use a periodic pattern (see FIG. 2) consisting of slits 210 or dipoles. With the construction of frequency-selective radomes, the most common way is with one or more layers of slits (aperture elements). This/these layer(s) can be constructed into a radome 120 according to FIG. 1 in order, thereby, to also create a certain electromagnetic protection.

Figure 3:
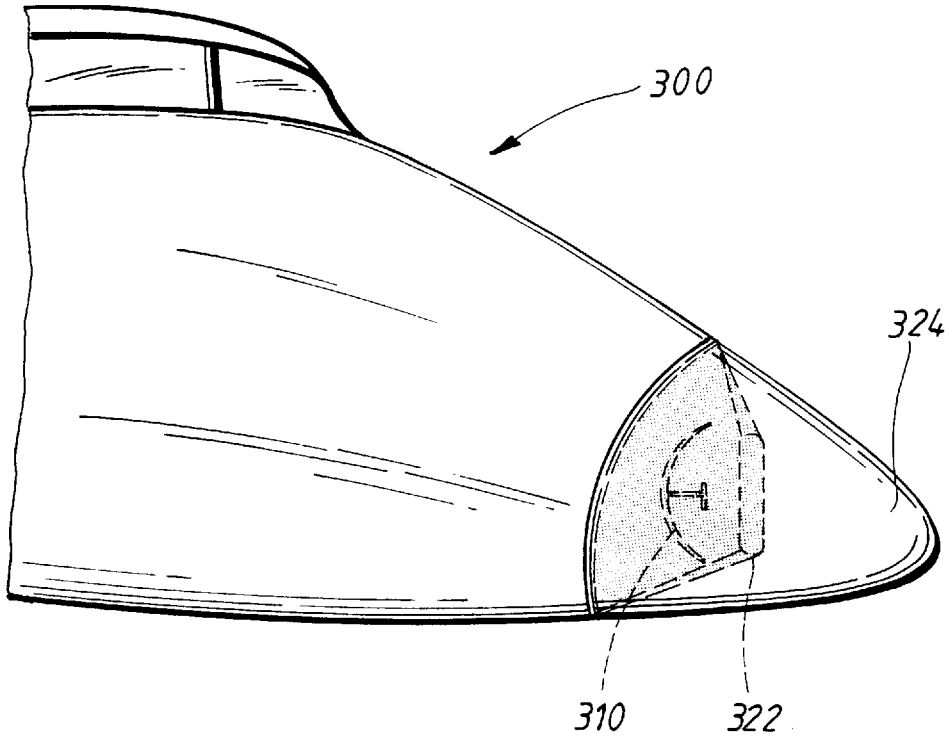
FIG. 3 shows an additional schematic example of an aeroplane's nose with a radome which can be provided with the invention, FIG. 4A schematically shows an embodiment of the frequency selective arrangement the present invention.

It is not necessary to put the outer radome together with the frequency-selective surface and it can even be advantageous not to do this so as to have control over the radar signature. In FIG. 3, a frequency-selective surface 322 is separate from an outer radome 324 in front of a sensor/antenna 310, in order for example to form the frequency-selective surface 322 as a corner reflector so as to increase and obtain an equivalent reflection surface which is several times larger than the geometrical surface. It can be valuable for commercial aeroplanes 300 to be electromagnetically clearly visible, i.e. with radar, but less desirable in other connections. If it is desired not to be electromagnetically visible, the frequency-selective surface 322 in FIG. 3 or the radome 120 in FIG. 1 (with a frequency-selective layer) can be geometrically formed in order to minimise their equivalent reflection surfaces.

In order to obtain a controllable and predictable radar signature by means of, for example, a special geometrical form of a radome with a frequency-selective surface or only one frequency-selective surface (in order to increase or reduce their equivalent reflection surfaces), it is necessary that the frequency-selective surface only transmits (allows to pass through) radiation with the desired frequency/frequencies. The conventional way of constructing a frequency-selective surface/radome, with one or more layers consisting of aperture elements, such as slits, in a periodic pattern, creates problems (as previously mentioned) with multiple transmission windows as well as the undesirable occurrence of grating lobes.

In order to solve the problems with multiple transmission windows and the occurrence of grating lobes in the radar signature which are present with conventional frequency-selective surfaces/radomes, many factors have to be fulfilled. The surface/radome has to be made to reflect instead of transmit at frequencies which are separate from, and furthermore at multiples of, the desired transmission frequency/frequencies. The surface which the external incident radiation field sees, and which it is reflected in, has to be constructed so that it does not generate grating lobes until frequencies which are a long way from desirable transmission frequency/frequencies are reached (for example about $6f_0$).

By combining both types of layers with periodic patterns of elements (apertures or conductive elements) in a specific way in different layers (levels), a construction is obtained which minimises the problems with multiple pass-bands and an early (in terms of frequency) occurrence of grating lobes in a frequency-selective surface/radome.

In accordance with the present invention (see FIG. 4A) of a frequency-selective surface/arrangement 400, at least two layers 410, 420 with periodic patterns are combined. The first and outer layer 410 comprises at least one layer 412 with a periodic pattern of conductive elements of the dipole type, the second and inner layer 420 comprising at least one layer 422 with a periodic pattern of aperture elements of the slit-type.

The outer layer 410 is dimensioned for a reflection resonance at about $3f_0$. The obtained layer presents stop-band characteristics according to FIG. 5, where the X-axis is frequency, the Y-axis is transmission and $f_0$ the desired transmission frequency. It should be noted that the reflection resonance is dimensioned for approximately the frequency $3f_0$. Since the elements are resonant at about $3f_0$, the packing density of the periodic pattern can furthermore be adapted so that no grating lobes occur before about $6f_0$.

Figure 7:
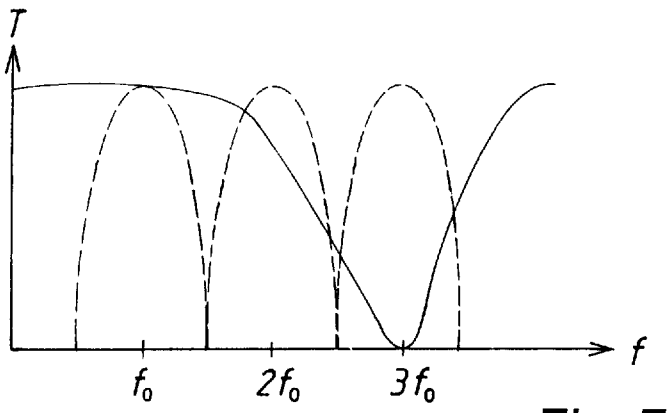
FIG. 7 shows FIGS. 5 and 6 in an overlaid relationship.
Figure 8:
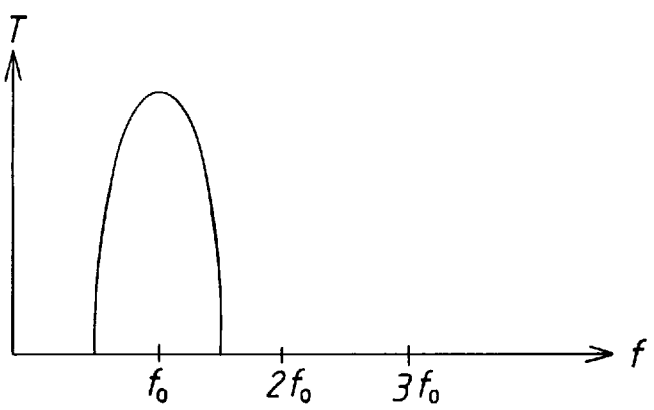
FIG. 8 shows the resulting frequency characteristics of a layer having conductive elements and a layer having aperture elements according to the present invention, and FIG. 9A schematically shows an additional embodiment of the present invention.

The inner layer 420 is dimensioned for a transmission resonance at $f_0$, i.e. a pass-band filter is obtained, together with the flaws of such as mentioned above. By combining this pass-band filter (see FIG. 6) with the previously dimensioned band-stop filter according to FIG. 5, which is placed closer to the surroundings, a pass-band filter (see FIG. 8) is obtained without multiple pass bands and with a considerable shift of the grating lobe occurrence on the outside of the surface/radome upwardly in the frequency direction to about $6f_0$. FIG. 7 shows how the two different transmission diagrams appear, overlaid one upon the other.

The important thing in the combination is that the layer closer to the surroundings (outer) has to be the reflecting layer which hides the transmitting layer (inner) for frequencies above the desired resonance frequency $f_0$. The grating lobes will occur on the inside of the surface/radome closer to $f_0$, but lack significance for the external radar signature.

Figure 4A:
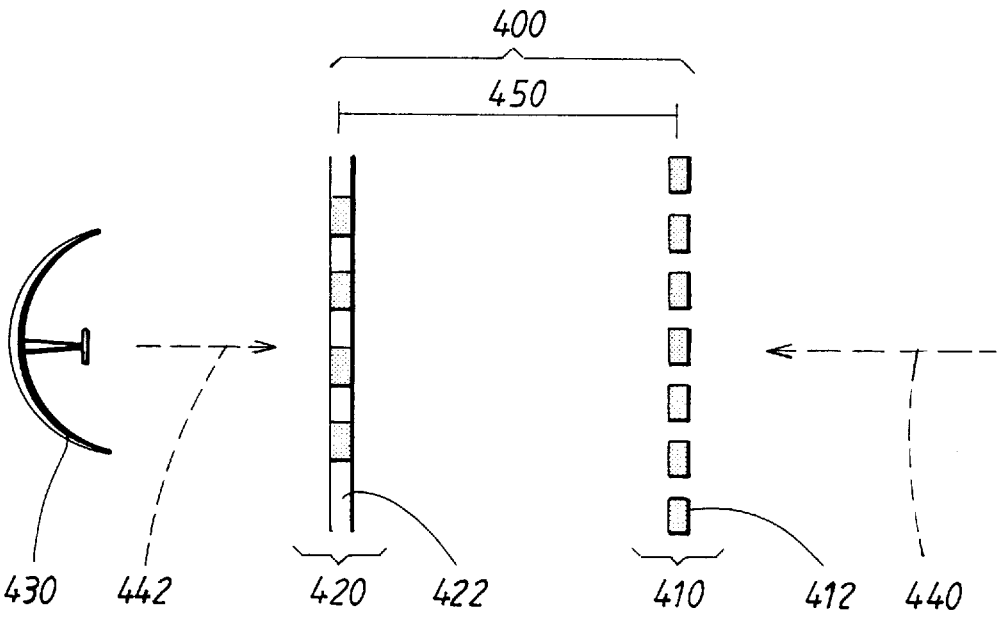
FIG. 4B illustrates an alternative embodiment of the arrangement of FIG. 4A.

The distance 450, according to FIG. 4A, between the two layers 410, 420 can be chosen in dependence upon characteristics that it is wished that the surface/radome should have. Preferably a distance can be chosen which is about $\lambda/4$, where it may even advantageously be about $\lambda/4+n\lambda/2$, where n=1, 2, 3, . . . (noting that $\lambda$ is the electrical wavelength in the substrate). Other distances between the layers can of course be chosen depending on which characteristics are desired. It is also imaginable that the interspace between the layers consists of air, but for practical reasons a porous material is normally used, the dielectric characteristics of which are as similar to air as possible.

The choice of elements is not limited to slits and dipoles, but instead any type of aperture elements whatsoever (slits, ring-slits, tri-slits etc.) and respectively any type of complementary conductive elements whatsoever (dipoles, rings, tripoles, etc.) can be combined in this construction. Arbitrary conductive materials like copper, aluminium etc., can be used for manufacturing of the aperture elements and the conductive elements. The choice between these can depend on factors like cost, machining, durability etc. The thickness of the conductive material which is used is normally of the order of tenths of mm to hundredths of mm thick. The conductive elements are arranged on an arbitrary dielectric such as for example glass-fibre, kevlar, thermoplastic etc. The choice between these can, as previously, depend on factors such as cost, machining, durability, temperature range etc.

Figure 4B:
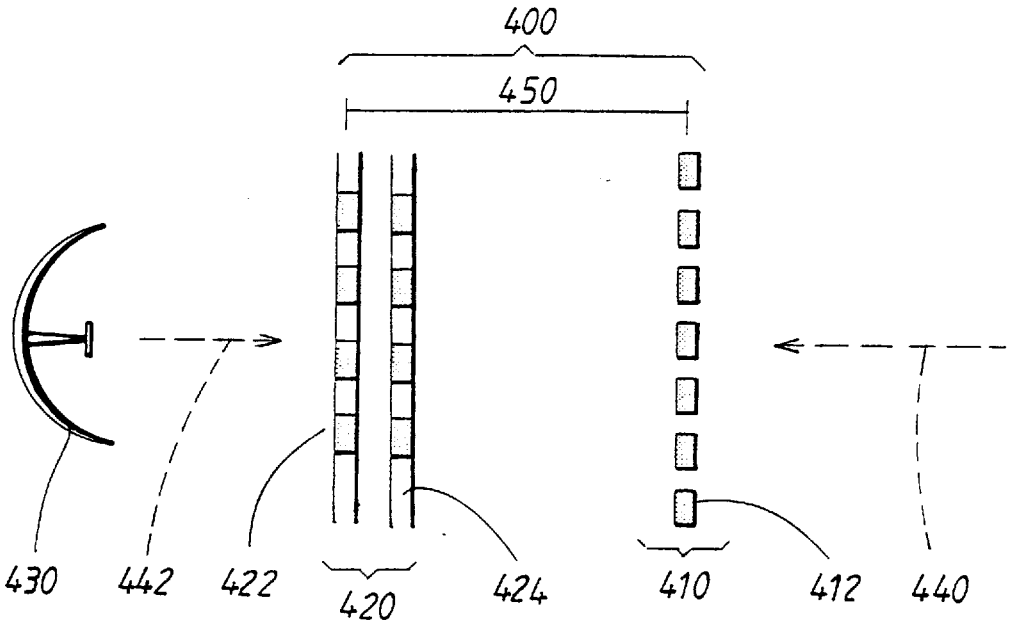
Figure 5:
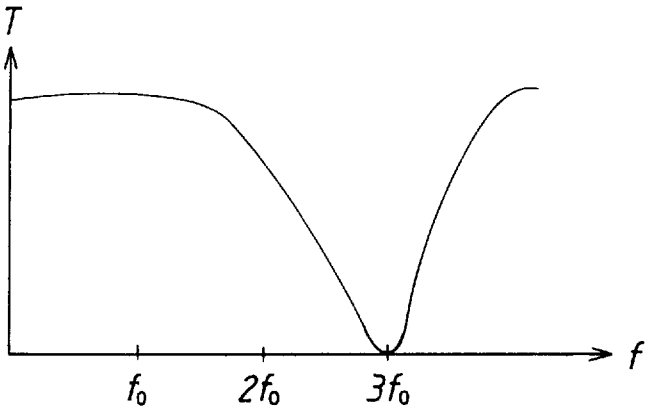
FIG. 5 shows a schematic diagram of the frequency characteristics of a layer having a periodic pattern with conductive elements which are comprised in the present invention.
Figure 6:
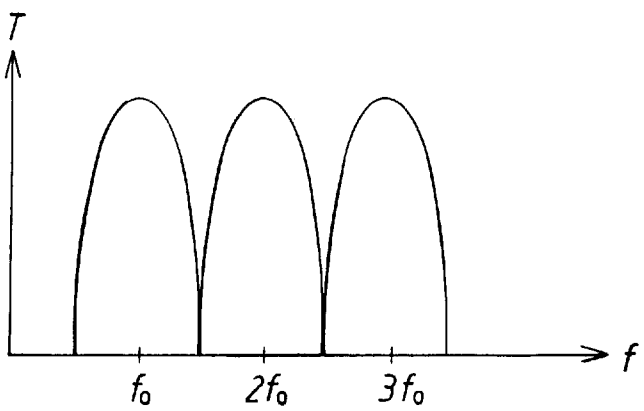
FIG. 6 shows a schematic diagram of the frequency characteristics of a layer having a periodic pattern with aperture elements which are comprised in the present invention.

In order to additionally amplify the filter function and produce a larger gradient in the filter edges, or in order to produce another filter function, one or both of the layers may have several layers. This means that respective layers of apertures/conductive elements can consist of two or more layers with the same, or similar, type of element. For example, FIG. 4B shows an alternative embodiment to the arrangement of FIG. 4A in which the inner layer 420 includes two layers 422 and 424.

When using several layers, the layers with aperture elements are separated with a dielectric at at least a distance which can ensure that the different layers are electrically insulated from one another. The layers with conductive elements are separated by at least the dielectric, on which they are arranged. In the case that the outer layer comprises two layers, it is imaginable that these are arranged with conductive elements on respective sides of a dielectric, on which they are arranged.

The transmission resonance frequency and the reflection resonance frequency in each layer in the inner and the outer layer respectively can be substantially the same (as similar as possible in a manufacturing sense to construct each layer to have the same reflection resonance frequency or transmission resonance frequency) or lie somewhat shifted, up to and including 10% in terms of frequency relative to each other.

The reason for choosing similar or somewhat varying frequencies for the different layers is entirely dependent on which characteristics it is desired that the frequency-selective surface should have. In the case where it is desired that the frequency-selective surface should be transparent for more than one transmission frequency, it may be suitable to choose a transmitting layer for each transmission frequency and to have a transmission resonant frequency for each transmission frequency.

Figure 9A:
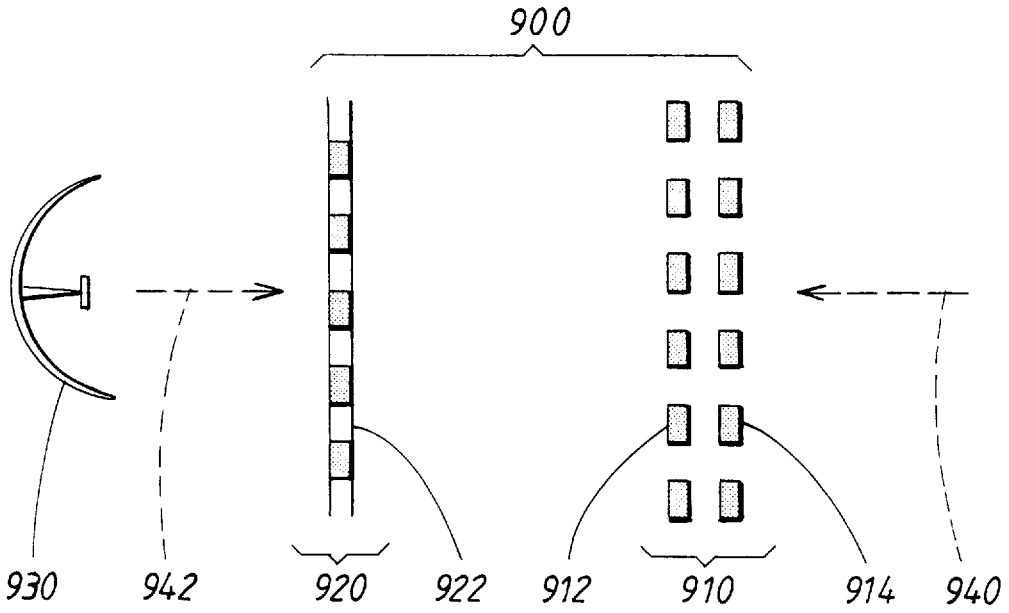
FIG. 9B illustrates an alternative embodiment of the arrangement of FIG. 9A.
Figure 9B:
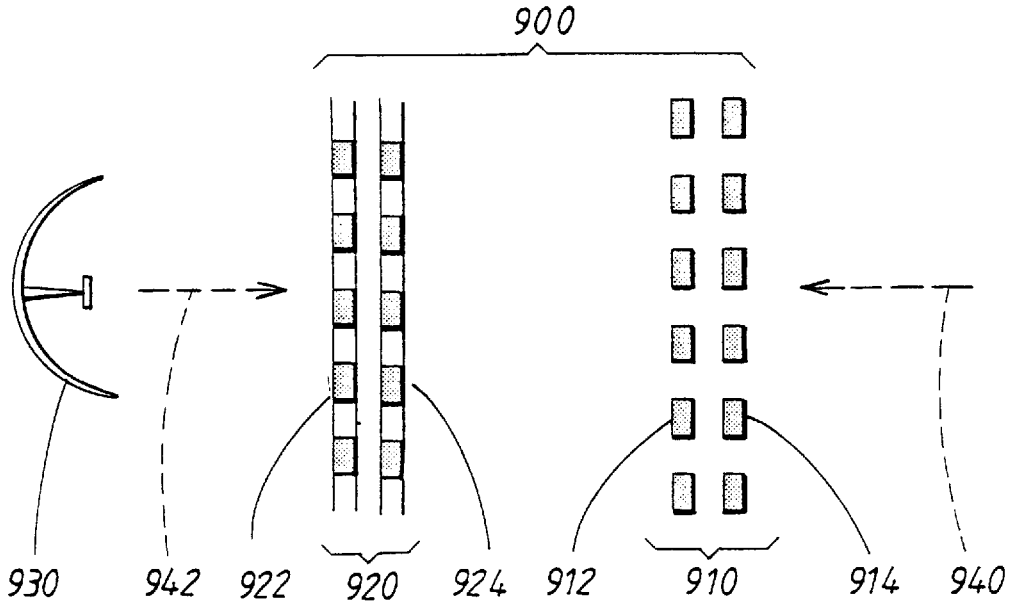

This however increases the complexity of the whole radome construction. A suitable choice is two layers with elements of the dipole type combined with one to two layers with elements of the slit type. FIG. 9A shows a preferred embodiment of a frequency-selective surface 900 according to the present invention. The outer layer 910 comprises two layers 912, 914 with elements of dipole type in this embodiment. The inner layer 920 comprises a layer 922 with elements of the slit type. Incident 940 and emitted 942 electromagnetic radiation can in this way reach, and be transmitted from, sensor/antenna 930 at the desired frequency/frequencies. FIG. 9B shows an alternative embodiment to the arrangement of FIG. 9A in which the inner layer 920 includes two layers 922, 924.

The invention is not limited to the aforementioned embodiments, but can be varied within the scope of the appended claims.

What is claimed is:

1. A frequency-selective arrangement for transmission therethrough of electromagnetic radiation around at least one predetermined transmission frequency, the frequency-selective arrangement comprising a plurality of adjacent layers forming a shield for positioning in front of at least one antenna arrangement, the shield including at least a first layer and a second layer, the first layer being arranged closer than the second layer to the at least one antenna arrangement, wherein the second layer includes at least one electromagnetic reflecting layer having a periodic pattern of electrically conductive elements, where said periodic pattern of electrically conductive elements is selected to possess a reflection resonance frequency for electromagnetic radiation which higher than said predetermined transmission frequency, and the first layer includes at least one electromagnetic transmitting layer placed at a predetermined distance from the second layer, said first electromagnetic transmitting layer having a periodic pattern of aperture elements, wherein said periodic pattern of aperture elements is selected to possess a transmission resonance frequency for electromagnetic radiation which is substantially equal to said predetermined transmission frequency.

2. A frequency-selective arrangement according to claim 1, wherein said reflection resonance frequency is of the order of three times higher than said predetermined transmission frequency.

3. A frequency-selective arrangement according to claim 1 or 2, wherein said predetermined distance between the first and the second layer is approximately equal to $\lambda/4+n\lambda/2$, where n=0, 1, 2, 3, . . . and where $\lambda$ is the electrical wavelength.

4. A frequency-selective arrangement according to claim 1, wherein said second layer includes two electromagnetic reflecting layers.

5. A frequency-selective arrangement according to claim 4, wherein said two electromagnetic reflecting layers have substantially the same reflection resonance frequencies.

6. A frequency-selective arrangement according to claim 4, wherein said two electromagnetic reflecting layers have reflection resonance frequencies which are shifted within 10% relative to one another.

7. A frequency-selective arrangement according to claim 1, wherein said first layer includes two electromagnetic transmitting layers.

8. A frequency-selective arrangement according to claim 7, wherein said two electromagnetic transmitting layers have substantially the same transmission frequencies.

9. A frequency-selective arrangement according to claim 7, wherein said two electromagnetic transmitting layers have transmission frequencies which are shifted within 10% relative to one another.

10. A frequency-selective arrangement for transmission therethrough of electromagnetic radiation around at least one predetermined transmission frequency, the frequency-selective arrangement comprising a plurality of adjacent layers forming a shield for placement in front of at least one antenna arrangement, the shield including at least a first layer and a second layer, the first layer being arranged closer than the second layer to the at least one antenna arrangement, wherein the second layer includes two electromagnetic reflecting layers each having a periodic pattern of electrically conductive elements, where said periodic pattern of electrically conductive elements is selected to possess a reflection resonance frequency for electromagnetic radiation which is about three times higher than said predetermined transmission frequency, and the first layer includes one electromagnetic transmitting layer placed at a distance from the second layer, which is approximately equal to $\lambda/4$, $\lambda$ being the electrical wavelength, said electromagnetic transmitting layer having a periodic pattern of aperture elements, wherein said periodic pattern of aperture elements is selected to possess a transmission resonance frequency for electromagnetic radiation which is substantially equal to said predetermined transmission frequency.

* * * * *